US008869661B2

(12) United States Patent
Opstad

(10) Patent No.: US 8,869,661 B2
(45) Date of Patent: Oct. 28, 2014

(54) TOOL FOR THE HANDLING OF A PROTECTION DEVICE FOR SUBSEA ELECTRICAL OR FIBER OPTICAL CONNECTORS

(75) Inventor: Ketil Opstad, Gralum (NO)

(73) Assignee: Nexans, Paris (FR)

( * ) Notice: Subject to any disclaimer, the term of this patent is extended or adjusted under 35 U.S.C. 154(b) by 259 days.

(21) Appl. No.: 13/491,825

(22) Filed: Jun. 8, 2012

(65) Prior Publication Data

US 2013/0025419 A1 Jan. 31, 2013

(30) Foreign Application Priority Data

Jul. 28, 2011 (NO) ..... 20111074

(51) Int. Cl.

| | |
|---|---|
| ***B25B 13/48*** | (2006.01) |
| ***B25B 27/14*** | (2006.01) |
| ***H01R 13/443*** | (2006.01) |
| ***B63C 11/52*** | (2006.01) |
| *H01R 13/625* | (2006.01) |
| *H01R 43/26* | (2006.01) |

(52) U.S. Cl.

CPC ..... *H01R 13/443* (2013.01); *H01R 13/625* (2013.01); *H01R 43/26* (2013.01); *B63C 11/52* (2013.01)

USPC ..... 81/487

(58) Field of Classification Search

USPC ..... 81/487, 176.2, 124.2; 405/169, 170, 405/190, 191, 303

See application file for complete search history.

(56) References Cited

U.S. PATENT DOCUMENTS

| | | | | |
|---|---|---|---|---|
| 5,005,451 | A * | 4/1991 | Lee et al. | 81/487 |
| 5,012,707 | A * | 5/1991 | DiBiagio | 81/124.2 |
| 5,031,981 | A * | 7/1991 | Peterson | 385/56 |
| 6,901,825 | B1 * | 6/2005 | Lebron | 81/124.2 |
| 8,459,155 | B2 * | 6/2013 | Canizares et al. | 81/451 |
| 2008/0011128 | A1 * | 1/2008 | Stephens | 81/124.2 |
| 2013/0309032 | A1 * | 11/2013 | Waseby | 408/1 R |

* cited by examiner

*Primary Examiner* — David B Thomas
(74) *Attorney, Agent, or Firm* — Sofer & Haroun, LLP

(57) ABSTRACT

A tool (1) for the handling by a Remotely Operated Vehicle (ROV) of a protection device (4) provided to protect a subsea electrical or optical fiber connector. The main feature of a tool is that said tool (1) is attached to the ROV and comprises a ROV friendly handle (2).

10 Claims, 1 Drawing Sheet

TOOL FOR THE HANDLING OF A PROTECTION DEVICE FOR SUBSEA ELECTRICAL OR FIBER OPTICAL CONNECTORS

RELATED APPLICATION

This application claims the benefit of priority from Norwegian Patent Application No. 2011 1074, filed on Jul. 28, 2011, the entirety of which is incorporated by reference.

BACKGROUND

1. Field of the Invention

The invention relates to a tool for handling a protection device intended to protect subsea electrical or fiber optical connectors, so called dummy connectors.

2. Description of Related Art

Nowadays, some protection devices intended to protect subsea electrical or fiber optical connectors are equipped with a Remotely Operated Vehicle (ROV) friendly handle and hence they can be handled without any problem by a ROV, to install or to recover said protection devices. But, some other existing protection devices are outfitted only with rope or wire instead of a ROV friendly handle, and which have the disadvantage if said rope or wire breaks. In this case, the ROV have a difficult task and may damage the protection device and the connector.

OBJECTS AND SUMMARY

The tool according to the invention has been developed to allow the protection devices equipped only with a simple rope or wire to be easily handled by a ROV to install or to recover such protection devices on subsea electrical or optical fiber connectors. This way, a protection device with a broken rope or wire or without ROV handle does not constitute any more a problem to be installed or recovered, because it can be handled as easily as a protection device outfitted with such ROV handle. In addition, the tool can reinstall a dummy connector with the said rope or wire instead of a ROV friendly handle.

The object to the invention is a tool for the handling by a Remotely Operated Vehicle (ROV) of a protection device provided to protect a subsea electrical or optical fiber connector. The main feature of a tool according to the invention is that said tool comprises a ROV friendly handle and a connection interface intended to interact with the protection device. In a general way, a handle is necessary to allow a ROV to easily handle a protection device provided to protect subsea electrical or optical fiber connector. The principle of the invention is to displace said handle from said protection device to a tool in order to attach said tool to the ROV. The connection interface is designed to attach or to disconnect the protection device. This way, a protection device equipped only with a broken rope or wire, or without handle, can also be easily handled by a ROV on which a relevant tool according to the invention is connected. A protection device is a dummy connector which is placed around the real connector to protect the electrical pins or fibers contacts from damage. This dummy connector is useful during installation until further tie-in and connection. In order to be easily and rapidly handled by a ROV, said tool must not be too cumbersome or too heavy. Moreover, the tool design must be also simple to be easily manufactured.

Advantageously, the handle is composed of a plurality of tubular elements. This preferred invention embodiment is easier to manufacture.

In a preferential way, all the tubular elements are arranged together so that they are aligned in a same geometrical plan. This way, the handle is not too cumbersome and may also easily be caught by the ROV.

Preferentially, the connection interface shape is complementary of that of the protection device. Advantageously, the connection interface must be equipped with connection means which can easily interact with complementary connection means of said protection device. The connection interface and the protection device are intended to fit together exactly.

In an advantageous way, the connection interface comprises a cylindrical body with two slots which are made to fit the type of protection device to be handled. Generally the protection device is cylinder shaped and the cylindrical body is intended to be placed all about said protection device. Said slots are dimensioned to cooperate with protection device protrusions. The connection interface is thus submitted to two successive movements: in the case of a protection device recovering, the connection interface slides linearly over the protection device, and then turns a little to lock said protection device inside said connection interface. The ROV pulls out the tool with the protection attached. In the case of a protection device installation, the protection device is attached to the connection interface, and then it is brought up to the real connector to slide over it. The connection interface turns a little to be separated from said protection device fixed on the connector.

Advantageously, the two slots are diametrically opposite.

In a preferential way, each slot comprises a first straight part which extends along a longitudinal direction of the body and a second curvilinear part which extends along the circumference of said body.

In a preferential way, the cylindrical body comprises a spring to keep the dummy connector in position.

Preferentially, an intermediate tapered part connects the handle to the cylindrical body.

In an advantageous way, the cylindrical body and the tapered part are made one piece.

Advantageously, the tool is made of a sea-resistant material if the tool is intended to have a long life cycle. But all materials can be used.

The advantage of a tool according to the invention is that it enables fast and safe recovery of protection device with a broken wire or rope, or installation of a protection device without ROV handle. Said tool has also the advantage of being of a compact and simple design, and may also be manufactured with a not too expensive material, such as steel.

BRIEF DESCRIPTION OF THE DRAWINGS

A detailed description of one preferred embodiment of a tool according to the invention is given, referring to FIGS. 1 to 2.

DETAILED DESCRIPTION

Figure 1:
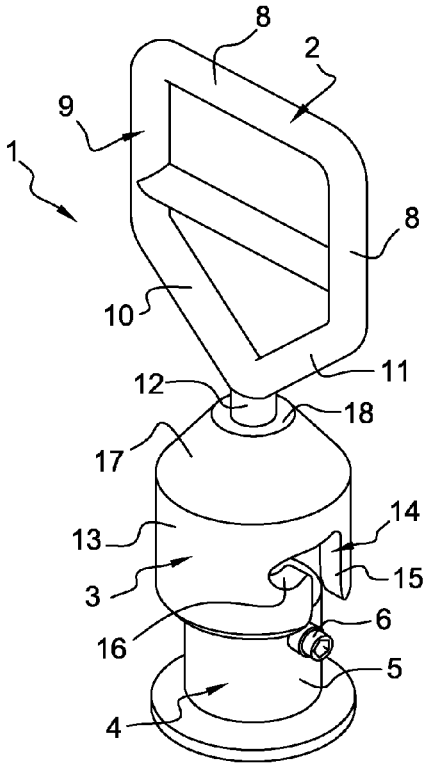
FIG. 1 is a perspective view of a tool according to the invention, also showing a protection device.
Figure 2:
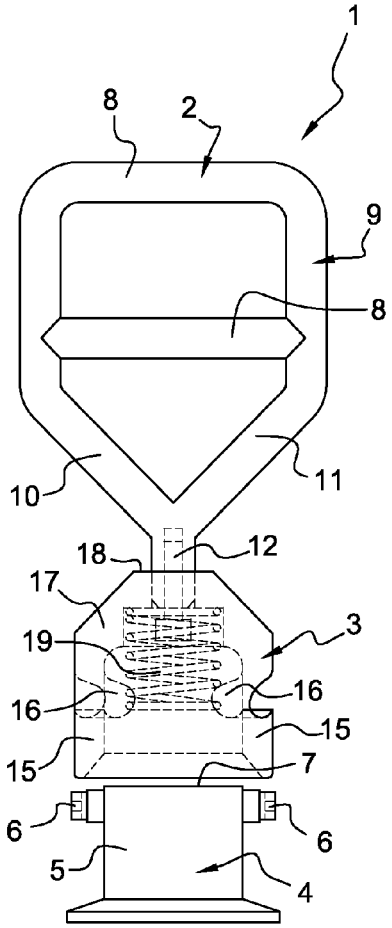
FIG. 2 is a cross-sectional view of the tool of the FIG. 1.

Referring to FIGS. 1 and 2, a tool 1 according to the invention comprises two main parts, one represented by a handle 2 and the other by a dummy connector interface 3 intended to come in contact with a protection device 4 of a subsea electrical or optical fiber connector. A protection device is composed of a dummy connector 4 which may be assimilated to a cap covering the real connector. A dummy protection connector 4 is made of a cylindrical hollow body 5 comprising two cylindrical side protrusions 6 extending in opposite directions. in other words, the two protrusions 6 are diametrically opposite and are aligned along the same radial axis. The body 5 is closed at one of its ends by a plane circular wall 7 and may comprise a rope or a wire not represented on the figures, and which is used to handle said dummy protection connector 4. The handle 2 is composed of a plurality of tubular elements 8 which are arranged together to be aligned in the same geometrical plane in order to be easily handled by a ROV and not to be too cumbersome. More precisely, the handle 2 comprises a rectangular frame 9 made of for tubular elements 8, said rectangular frame 9 being prolonged by two tubular elements 10, 11 which meet to form a terminal point 12. The dummy connector interface 3 comprises a cylindrical hollow body 13 with two side slots 14 which are diametrically opposite. Each slot 14 is composed of a first straight part 15 which extends along a longitudinal axis of said body 13 and a second curvilinear part 16 which extends along the circumference of the body 13. The first part 15 is achieved from an end edge of the body 13, whereas the second part 16 is carried out inside said body 13. The body 13 is prolonged at one of its ends by a tapered part 17 itself prolonged by the handle 2. More precisely, the body 13 and the tapered part 17 are made one piece, and the terminal point 12 of the handle 2 is fixed to the shrunk end 18 of said tapered part 17. A preloaded spring 19 is placed wherein the connection interface body 13. Without any external pressure, the preloaded spring 19 lies in a predetermined position inside the body 13, and is locked by an abutments system. This way, the preloaded spring 13 can only be compressed a little more from said predetermined position.

The tool 1 according to the invention is attached to a ROV, and may be used in two different cases. The first case is concerning the installation of a dummy protection connector 4 without a handle. in this case, the tool 1 has a dummy protection connector 4 attached. The ROV installs said dummy connector 4 into the receptacle in the subsea termination. Then the ROV turn the tool 1 little to disconnect said tool 1 from the dummy connector 4, and finally said ROV pulls out the tool 1. The second case is concerning the recovery of the dummy connector 4 with a broken rope or wire, in this case, the connection interface body 13 slides over the dummy connector 4 in the subsea termination, so that each protrusion 6 slides along the first straight part 15 of each slot 14. Then the ROV turns little said body 13 so that said each protrusion 6 abuts against the end of each curvilinear part 16 of said slot 14. The spring 19 keeps the dummy connector 4 in position. Finally, the ROV pulls out the tool 1 with the dummy protection connector 4 attached. In a general way, the first straight part 15 of each slot 14 is used to compress or to release the preloaded spring 19, and the second curvilinear part 16 is used to lock or unlock the dummy protection connector 4 inside the connection interface body 13, in a position in which said spring 19 is a little more compressed.

The invention claimed is:

1. A tool for the handling by a Remotely Operated Vehicle (ROV), of a protection device provided to protect a subsea electrical or optical fiber connector, where the protection device is a cap covering said electrical or optical fiber connector being formed as a hollow cylindrical body, said tool comprising:

an ROV friendly handle; and a connection interface formed as a cylindrical body intended to interact with said hollow cylindrical body of said protection device.

2. The tool according to claim 1, wherein the handle is composed of a plurality of tubular elements.

3. The tool according to claim 2, wherein all the tubular elements are arranged together so that they are aligned in a same geometrical plan.

4. The tool according to claim 1, wherein the connection interface shape is complementary of that of the protection device.

5. The tool according to claim 4, wherein the connection interface is a cylindrical body with two slots each of which are dimensioned to receive protrusions on the cylindrical hollow body of said protection device to be handle.

6. The tool according to claim 5, wherein the two slots are diametrically opposite.

7. The tool according to claim 5, wherein each slot comprises a first straight part which extends along a longitudinal direction of the body and a second curvilinear part which extends along the circumference of said body.

8. The tool according to claim 5, wherein the cylindrical body of said handle has a spring to keep the protection device in position.

9. The tool according to dam 5, wherein an intermediate tapered part of said tool connects the handle to the cylindrical body.

10. The tool according to claim 9, wherein the cylindrical body and the tapered part are made one piece.

* * * * *

UNITED STATES PATENT AND TRADEMARK OFFICE

CERTIFICATE OF CORRECTION

PATENT NO. : 8,869,661 B2
APPLICATION NO. : 13/491825
DATED : October 28, 2014
INVENTOR(S) : Opstad It is certified that error appears in the above-identified patent and that said Letters Patent is hereby corrected as shown below:

IN THE CLAIMS:

Column 4, Claim 9, Line 43: The word "dam" between the word "to" and the number "5" should read as: "claim"

Signed and Sealed this
Seventeenth Day of February, 2015

Michelle K. Lee

Michelle K. Lee
*Deputy Director of the United States Patent and Trademark Office*